United States Patent [19]

Skaggs

[11] 4,225,039

[45] Sep. 30, 1980

[54] CONTAINER CASE AND BLANK THEREFOR

[75] Inventor: Kenneth R. Skaggs, Hoffman Estates, Ill.

[73] Assignee: Kollectible Kontainer Enterprises Ltd., Schaumburg, Ill.

[21] Appl. No.: 936,757

[22] Filed: Aug. 25, 1978

Related U.S. Application Data

[63] Continuation of Ser. No. 826,177, Aug. 19, 1977, abandoned.

[51] Int. Cl.[3] ..... B65D 75/04; B65D 77/00

[52] U.S. Cl. ..... 206/193; 206/474; 229/15; 229/34 HW; 229/42

[58] Field of Search ..... 190/16; 206/45.11, 141, 206/193, 201, 427, 429, 472, 474, 521; 229/15, 28 BC, 34 HW, 4 L, 5 L, 5 B, 5 BC, DIG. 6

[56] References Cited

U.S. PATENT DOCUMENTS

| | | | |
|---|---|---|---|
| 1,016,148 | 1/1912 | Heinicke | 229/42 |
| 3,193,092 | 7/1965 | Parsons | 206/408 X |
| 3,394,845 | 7/1968 | Vilanova | 229/28 R X |
| 3,487,479 | 1/1970 | Grooms | 229/15 X |
| 3,990,624 | 11/1976 | Melli | 229/15 X |

FOREIGN PATENT DOCUMENTS

| | | | |
|---|---|---|---|
| 0303241 | 1/1929 | United Kingdom | 229/42 |

*Primary Examiner*—Davis T. Moorhead

*Attorney, Agent, or Firm*—Fitch, Even, Tabin, Flannery & Welsh

[57] ABSTRACT

This invention relates to a display, carrying and/or storage case for containers such as beer cans and to a blank for erection into such a case. The carrying case is formed from a single piece, paperboard blank which is suitably scored or otherwise provided with fold lines for erection into an attache-like case having handles for facilitating carrying of the case. The case is formed with a pair of opposed container display sections which are joined about a hinged axis so they may be swung outwardly from a closed position to a generally V position for displaying the containers therein. A divider means divides each of the display sections into an array of compartments each of which receives and holds a container therein.

2 Claims, 8 Drawing Figures

CONTAINER CASE AND BLANK THEREFOR

This is a continuation of application Ser. No. 826,177, filed Aug. 19, 1977, now abandoned.

This invention relates to a paperboard blank for erection into a container case and also to a case for carrying, displaying and storing containers.

The present invention is directed to such a display, carrying and storage case having a large array of separate compartments each for holding a container such as an empty beer can. A typical beer can collector often has a collection of several hundred beer cans and usually lacks an effective and inexpensive manner for storing and/or carrying or displaying his beer cans. Some beer cans are quite valuable and their owner desires to prevent damage by scratching or denting, particularly when transporting the cans from one location to another. Transportation of a large number of cans usually is an incident to a trading session or to an exhibition or show for collectors.

The beer can collector, often a child, needs an inexpensive, yet practical and efficient storage, display and carrying case for transporting a large number of cans at one time, e.g., 48 cans or more. Heretofore it has been time consuming and difficult to handle and carry a large number of beer cans into or from a show and to display them effectively. To provide a low cost and lightweight storage case, the latter is preferably made from paperboard such as corrugated board with a plurality of internal dividers dividing the interior of the storage case into can receiving compartments. The preferred compartments are formed so that each can is held in position with a snug or wedge fit into its compartment so that it does not readily shift or fall from its compartment. The preferred case is also provided with handle means which allows an easy carrying of the case much like the manner of a typical attaché case. The display of the cans is particularly enhanced by forming it with a pair of opposed hinged display sections mounted for swinging movement from a closed carrying position to an open display position with the display sections being angularly disposed in a V shape for viewing the containers. In the V position, the case is self-supporting and need not be braced to prevent tipping. To protect the beer cans against damage, it is preferred to erect double thickness cushioning walls about ends of the case.

The preferred case is formed from a single piece of corrugated board which may be shipped and stored as a flat blank. Suitable fold lines and slots in the blank facilitate erection of the blank into a case without the use of any substantial equipment. Thus, the flat blanks may be shipped and displayed for sale with a minimum of space needed therefor. Moreover, the flat attaché-like cases can be readily stored underneath a bed or in a closet or in other places out of sight until it is time to inspect the cans.

Accordingly, a general object of the present invention is to provide a carrying case of the aforementioned kind.

A further object of the invention is to provide a one-piece paperboard blank which may be assembled into a display carrying and storage case for containers.

Other objects and advantages of the invention will become apparent from the detailed description taken in connection with the accompanying drawings in which.

Figure 2:
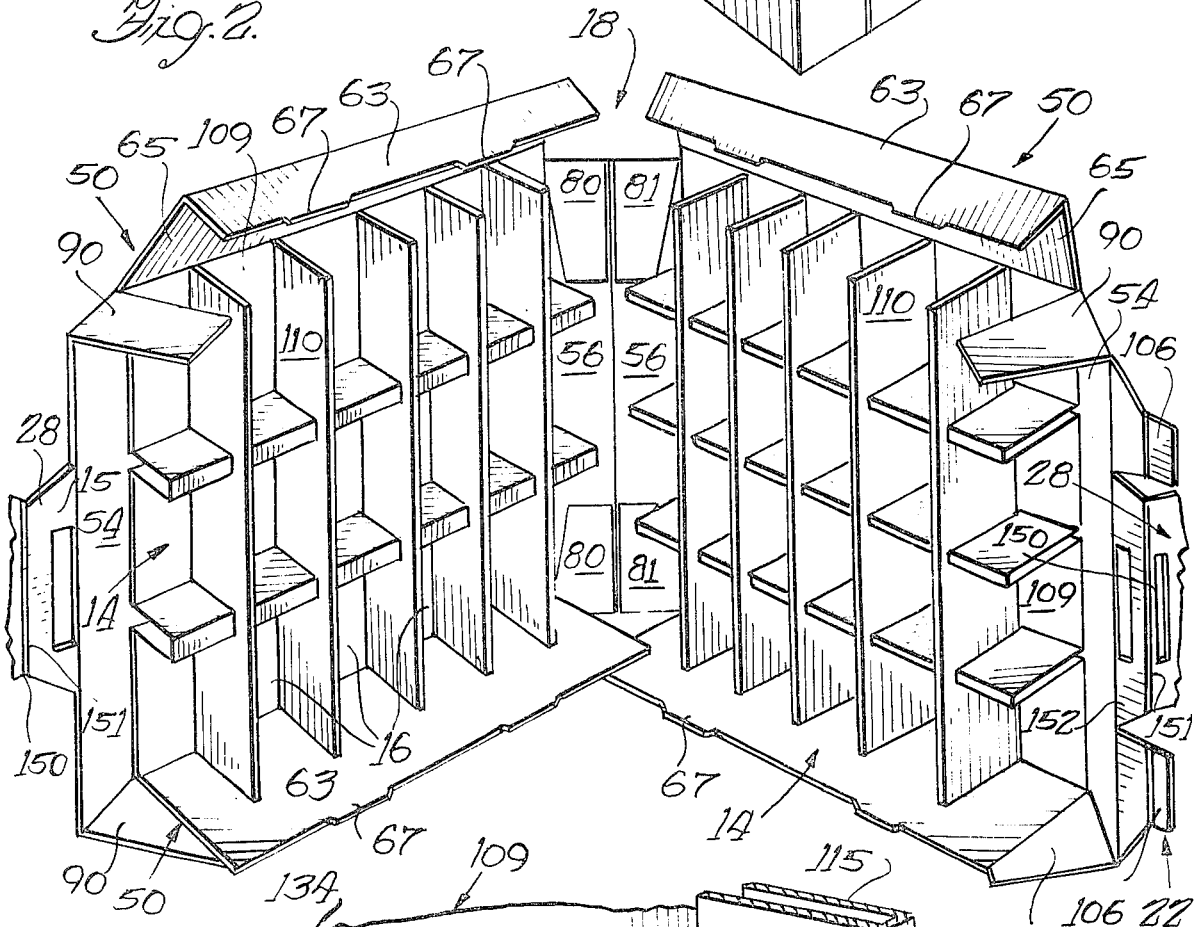
FIG. 2 is a partially assembled view of the container case of FIG. 1.

As shown in the drawings for purposes of illustration, the invention is embodied in a carrying case 11 having a pair of oppositely disposed display sections 12 each having an internal dividing means 14 dividing a display section into a plurality of individual compartments 16. Each of the compartments 16 is sized to receive and hold a container such as a beer can. Herein, each display section has 18 compartments so that a total of 36 large 16 oz. beer cans may be transported in the case 11. Typically, for storing 12 oz. beer cans, another row of cans is provided to hold 24 of the 12 oz. beer cans in each section 12. The preferred case 11 is provided with a hinging means 18 which defines an axis about which the display sections 12 may be swung from a closed position in which the display sections are disposed face-to-face with their internal compartments being aligned to an open display position in which the display sections 12 are disposed angularly to define a V-shape, as shown in FIG. 2. In the V-shaped open position, the case is self supporting against falling over.

Figure 1:
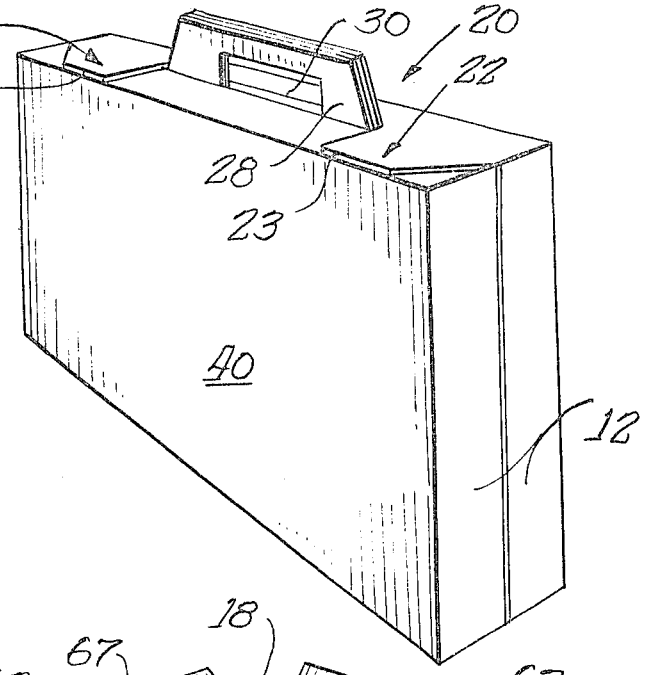
FIG. 1 is a perspective view of a container case embodying the novel features of the invention.

To facilitate the carrying of the case 11, a handle means 20 may be provided for grasping and carrying the case, particularly when the display sections 12 are in their closed position, as shown in FIG. 1. To prevent a spilling of cans or the inadvertently swinging open of one of the display sections, an interlocking means for the display sections may be provided. Herein, the interlocking means is in the form of tabs 22 on one display section which can be inserted into slots 23 in the other display section to lock the display sections in a closed position. The preferred handle means also assists in keeping the display sections together and is in the form of a pair of flaps 28 each on a display section with a hand receiving opening 30 in each flap. When the display sections 12 are closed, the flaps 28 will be abutted and the hand openings 30 will be aligned so that the fingers of a person may be inserted therein to grasp and hold the display sections together while carrying the case.

The carrying case 14 is preferably formed to be low cost and light weight by the use of a single piece blank or paperboard body 35 for erection to form the container case and with two separate divider means 14 each of which may be of separate parts from the paperboard body. As will be explained in greater detail, the preferred divider means is formed with divider strips or sections also of paperboard which are suitably slotted and interlaced with one another into a grid-like array to define the compartments 16. On the other hand, the divider means could be formed of a molded plastic or other material.

Figure 6:
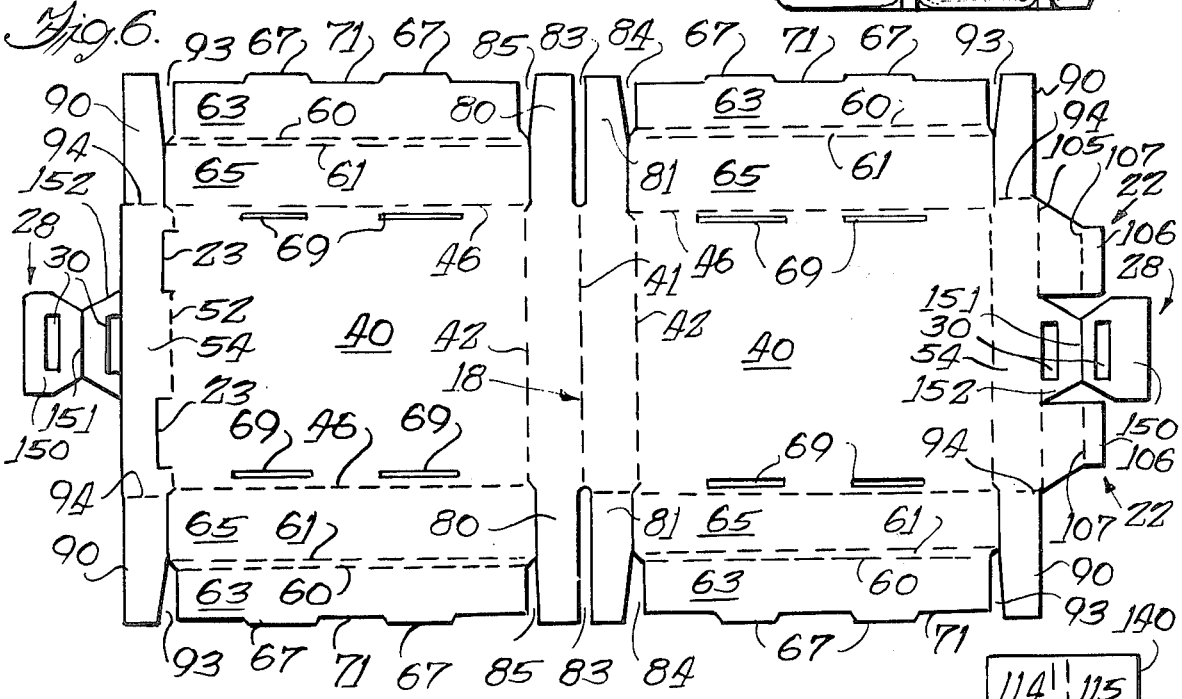
FIG. 6 is a view of a one-piece blank for erection into the container case.

Referring now in greater detail to FIG. 6 and to the blank 35, it is generally symmetrical to the left and to the right of a central fold line 41 and each half of the blank is provided with a pair of centrally located back panels 40 which form the back wall for each of the compartments 16 and which form the outer sides of the case 14 when the blank is erected into the carrying case. Herein, the back panels 40 are formed on their inner face edges by a pair of transverse fold lines 42 which may be die-cut, scored or otherwise preferred corrugated board material. Along the longitudinally extending margin of the blank 35 are longitudinally extending fold lines 46 and 48 which define the ends of the back panels 40 and define a fold line about which are folded end panels 50. Further die-cuts and fold lines are formed in the blank 40 at the transverse ends thereof at fold lines 52 to separate top and handle end panel 54 from the back panel 40. The bottom or central end wall panels 56 are separated from each other by the fold line 41 which is located at the hinging means axis 18, as will be explained in greater detail hereinafter.

It is preferred that the end panels 50 be of double wall thickness to provide increased cushioning for the beer can and also to provide additional strength and rigidity to the erected case. To this end, each of the end panels 50 is provided with a pair of longitudinally extending fold lines 60 and 61 spaced closely adjacent to one another and extending parallel to each other. The fold lines 60 and 61 divide the end panels 50 into an outer panel section 63 and an inner panel section 65. The outer panel section 63 of each end panel is folded over into face-to-face engagement with its associated inner section 65 with projecting lugs 67 on the outer edges of the sections 63 inserted into openings 69 in the central panel 40 adjacent the fold line 48. With the end panels erected, the outer marginal edges 71 of panel sections 63 will abut the interior surface of the backing panel 40 slightly inwardly of the fold lines 46 or 48, respectively.

To erect the bottom panels 56, each of the panels 56 is folded about its respective fold line 42 to a position generally normal to the attached back panel 40. The bottom panels 56 are held in the erected position by a pair of locking tabs 80 and 81 which are long finger-like projections which are spaced by die-cut slots 83, 84 and 85 from each other. The respective locking tabs 80 and 81 are adapted to be bent about fold line 87 to extend normal to the bottom panels 56 and to extend into the space between the folded end wall panels 63 and 65.

In a like manner, it is preferred that the top wall panels 54 also be provided with finger-like locking tabs 90 which are separated by die-cut 93 from the end wall panels. Each of the interlocking tabs 90 is folded about a fold line 94 with the top and bottom panels 54 for insertion between the double thickness panel sections 63 and 65 defining the end walls to positions to be facing the other interlocking tabs 80 and 81. In erecting the carton, it is to be understood that top and bottom panels 54 are folded about their fold lines 52 to positions generally normal to the plane of the back panels 40.

The preferred handle means comprises the pair of handle flaps 28 each of which is connected centrally to an associated top panel 54 at their outer edges at a central location thereon. The opening 30 for receiving the fingers is generally located in the center of the respective flaps 28.

To interlock the display sections of the erected case together to prevent spilling of cans, the locking projections 22 are formed adjacent the handle flap 28 and are separated by a fold line 105 from the top panel 54. Outer locking end lugs 106 on the locking flaps are bent normal to the inner portions of the locking projections 22 at fold lines 107. When bent, the lugs 106 are formed to be inserted into the locking slots 23 which are die-cut close to the other fold line 52 for the other top panel 54 in the other half of the blank. As will be understood, when the locking tabs 22 are inserted through the slots 23 they are gripped by the material at the slot to resist movement of the tabs 22 from the slots 23.

Figure 3:
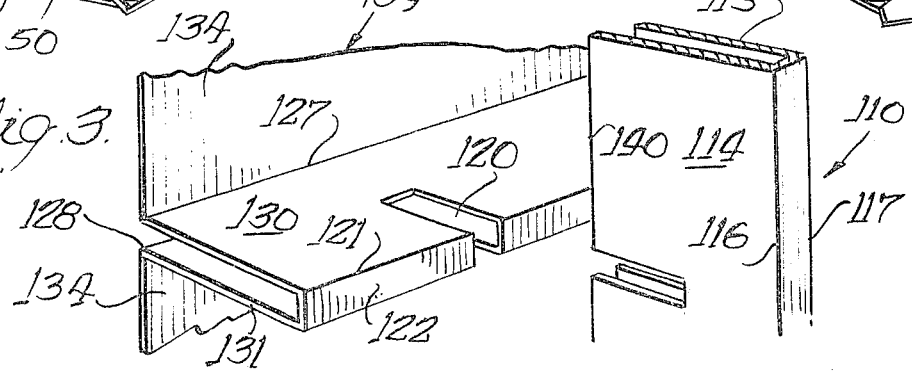
FIG. 3 is an enlarged fragmentary view of a divider means used with the container case of FIG. 1.
Figure 4:
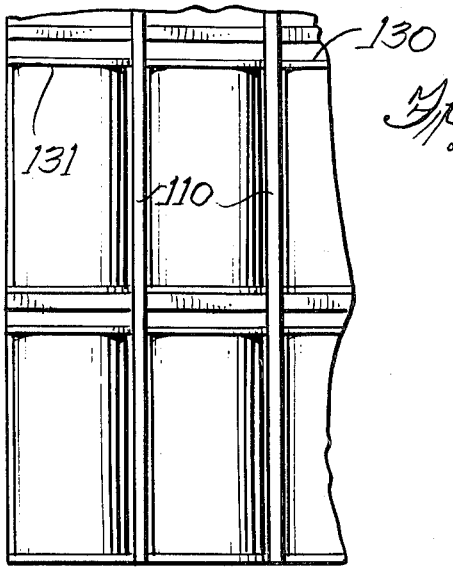
FIG. 4 illustrates containers mounted in the compartments of the case.
Figure 5:
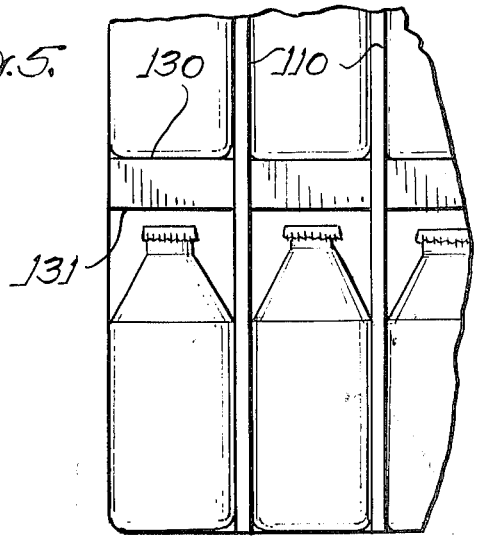
FIG. 5 illustrates the container case carrying bottles.
Figure 7:
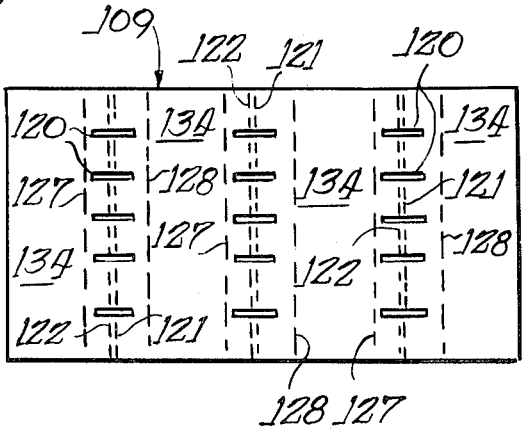
FIG. 7 illustrates a blank for assembling into a divider means.
Figure 8:
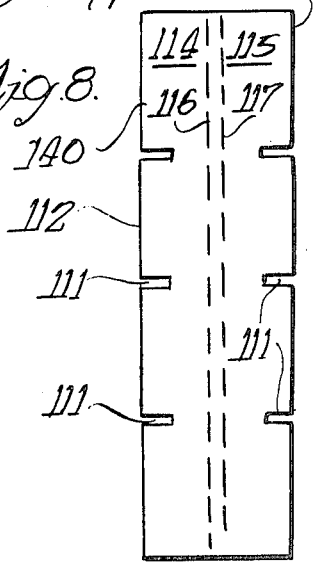
FIG. 8 illustrates a divider means.

Turning now to the preferred divider means 14, it is preferably formed of a divider sheet 109 (FIG. 7) and a series of divider strips 110 (FIG. 8) each formed of corrugated board Each of the divider strips 110 is formed with one or more transversely extending slots 111 extending inwardly from longitudinally extending edges 112 of the divider strip. Each of the slots 111 extend about half way across the width of its associated strip panel 114 or 115. Two such strip panels extend parallel to each other when bent along a pair of parallel fold lines 116 and 117. While similar divider strips could be made to join to the above-described divider strips 110 to form a grid-like array it is preferred to use a divider sheet 109 made of a single piece. The divider sheet 109, shown in FIG. 7, and the divider strip 110, shown in FIG. 8, actually form twenty-four compartments for 12 oz. cans. The divider strip 109 is formed with a series of slots 120 which extend across a pair of fold lines 121 and 122, as best seen in FIGS. 8 and 3, to receive therein a divider strip 110, as best seen in FIG. 3. A pair of further fold lines 127 and 128 are parallel to the fold lines 121 and 122 and allow walls 130 and 131 to be erected normal to the plane of the blank. The walls 127 and 128 define the top and bottom walls for each compartment 16. The flat back wall sections 134 of the divider sheet 109 define the back walls for the compartments 16. Thus, when the divider strips 110 are erected and the divider sheet 109 is erected, as shown in FIG. 3, they may be joined to form the grid-like array defining the can receiving compartments 16 therebetween. Herein the compartments have their lengthwise direction extending in a direction transverse the longitudinal dimension of the paperboard blank. The divider strips 110 and the divider sheet are so designed so that edges 140 of the divider strips 110 abut the back walls 134 of the compartments 16.

By way of example only, the preferred blank of corrugated board is about 52 inches in length and about 27 inches in transverse width. Each of the display panels may be about 16 1/13ths inches in the longitudinal direction and about 20 inches in the other direction. The width of the erected enclosing wall is preferably about 2 and 7/8ths inches.

Herein, the handle means 28 is preferably formed with four pieces or walls to provide a heavy duty handle to withstand rugged and heavy use without breaking. That is, the handle is formed with four plies each having a hand receiving opening 30 therein. As best seen in FIG. 6, a double thickness may be obtained by folding an outer ply 150 over at a fold line 151 into face-to-face engagement with an inner ply 152 to form a double thickness for the handle at each display section for the case with a portion of outer ply being located at the end wall 54. When display sections are closed, the handle plies 150 and 151 on each display section are aligned to provide the four ply thick handle, shown in FIG. 1. While the preferred handle is made with plies integral with the blank, it is within the purview of the invention to have one ply made separately and adhered to the other integral ply.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A display case adapted to swing open to a V-shape for displaying a large number of containers arranged in plural rows and columns and for carying and storing the containers, said case comprising a paperboard body; a pair of opposed container display sections erected from said paperboard body, each of said display sections comprising a central back panel, a pair of integrally attached opposite end panels integrally attached to said central panel along opposite longitudinal margins of said paperboard body, a pair of integrally attached top and bottom panels integrally attached to said central panel along the opposite transverse margins of said body, said end panels and said top and bottom panels being folded to project generally normal to said back panel to form an encircling wall about said back panel; divider means dividing each of said display sections into an array of compartments each for receiving and holding a container therein; fold line means in said paperboard body between said display sections joining said display sections for swinging movement relative to one another from a closed position in which said container receiving compartments are facing each other and closed to view and an open position in which said display sections are swung outwardly and disposed at an angle to each other to expose or display the container receiving compartments, said fold line means comprising a plurality of parallel fold lines extending transversely and a pair of bottom panels separated by a central one of said fold lines, said central one of said fold lines being at the axis about which the swinging movement takes place, handle means connected to said paperboard body for grasping when carrying the case; said handle means comprising at least one flap integrally attached to said paperboard body and having a hand-receiving opening therein; a locking means for interlocking the display sections together in the closed position, said locking means comprising at least one flap on one display section of said body and a slotted receiving means on the other display section for receiving said locking flap therein; said divider means in each of said sections comprising a first plurality of parallel walls of material sufficiently rigid to support a container resting thereon, spaced equidistantly from each other to receive cans therebetween, a plurality of cross walls of material sufficiently rigid to support a container thereon in said divider extending parallel to each other and substantially normal to said first walls, said cross walls and the said first walls defining with each other and with said encircling wall about said back panel a plurality of rows and columns of container receiving compartments each of the same size, each of said compartments having an opening for receiving insertion of a container directly through said opening, at least some of said walls defining said compartments being compressed when a can is inserted to hold the same in its compartment against loosely falling therefrom, each of said openings allowing withdrawal of a container from its associated compartment.

2. A case in accordance with claim 1 in which said first walls and said cross walls of said divider means comprises a folded double wall section adapted to be deflected by a container, said first walls and said cross walls being slotted and interlaced in a grid to define the rectangular array of compartments.

* * * * *